US006575207B2

(12) United States Patent
Ikemoto et al.

(10) Patent No.: US 6,575,207 B2
(45) Date of Patent: Jun. 10, 2003

(54) APPARATUS FOR OPENING CONTINUOUSLY CONVEYED BAGS

(75) Inventors: Iwao Ikemoto, Iwakuni (JP); Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 10/098,012

(22) Filed: Mar. 13, 2002

(65) Prior Publication Data

US 2002/0129868 A1 Sep. 19, 2002

(30) Foreign Application Priority Data

Mar. 13, 2001 (JP) ..... 2001-071286

(51) Int. Cl.[7] ..... B65B 1/04

(52) U.S. Cl. ..... 141/114; 141/179; 141/270; 141/279; 141/284; 53/385.1

(58) Field of Search ..... 141/10, 313, 114, 141/179, 178, 129, 181, 182, 185, 166, 270, 279, 284; 53/385.1

(56) References Cited

U.S. PATENT DOCUMENTS 2,370,292 A * 2/1945 Davies ..... 141/80
3,982,376 A 9/1976 Ikeda
4,253,904 A * 3/1981 Jodrey et al. ..... 156/497
5,224,523 A * 7/1993 Wardle ..... 141/4
6,035,606 A * 3/2000 Bussey et al. ..... 53/138.4

FOREIGN PATENT DOCUMENTS

JP 2001-278217 10/2001

* cited by examiner

*Primary Examiner*—Steven O. Douglas
(74) *Attorney, Agent, or Firm*—Koda & Androlia

(57) ABSTRACT

An opening apparatus that opens continuously conveyed bags with a gas supplied by nozzles. A plurality of nozzles having conical head sections and discharge openings at the tip ends are attached to a rotation transmitting member with equal spaces in between, and this rotation transmitting member is caused to revolve at a constant speed while maintaining a horizontal attitude by means of a parallel link mechanism. The nozzles revolve at a constant speed on a circular track in a vertical plane along the conveying direction of bags with the discharge openings consistently facing the bags. When the nozzles are at the lower point on the circular track, the head sections enter into the bags that are being conveyed at a constant speed, and a gas is caused to jet into the bags from the discharged openings, thus spread-opening the bags.

19 Claims, 9 Drawing Sheets

APPARATUS FOR OPENING CONTINUOUSLY CONVEYED BAGS

BACKGROUND OF THE INVENTION

1. Field of the Invention

The present invention relates to an opening apparatus for bags in which a nozzle is moved into mouths of respective bags that are continuously conveyed and a gas is jet into the bags from a discharge opening of the nozzle.

2. Prior Art

Continuous conveying type bag-filling packaging machines perform a series of packaging operations while self-standing bags are continuously conveyed. Such operations includes opening of the bag mouths, spreading of the bag bottoms by blowing a compressed gas into bags, filling of the bags with contents and sealing of the bag mouths.

Typical continuous conveying type bag-filling packaging machines include either one of two types of bag mouth opening apparatuses: a following-reciprocating motion type apparatus and a rotary loop type apparatus.

In the following-reciprocating motion type, a nozzle that blows a gas into the bags repeats a following motion and a return motion in the conveying direction of the bags. During the following motion, the nozzle is advanced toward the mouth of the corresponding bag and is inserted into mouth. Then, a gas is blown into the bag from the discharge opening of the nozzle, so that the bag bottom is spread open. The nozzle is next retreats and is separated from the bag mouth. However, this type has several problems.

First, a certain distance is required for the acceleration of the nozzle from a stopped state to a bag conveying speed, and a certain deceleration distance is also required in order to stop the nozzle after the nozzle is separated from the bag mouth. As a result, the distance required for the reciprocating motion of the nozzle tends to be correspondingly long, so that overall size of the packaging machine increases, requiring a large installation space.

Second, time is likewise required for acceleration and deceleration, and this hinders increase in the running speed of the packaging machine.

Third, since the reciprocating motion and advancing and retracting action of the nozzle are repeated, vibration and noise are considerable, deteriorating the working environment. This problem becomes more conspicuous as the packaging machine is operated at higher speeds.

Fourth, in cases where a plurality of sets of nozzles are installed and a plurality of bags are opened at one time, the inertia becomes large, thus requiring an additional distance and time for acceleration and deceleration, leading to an increase in the size of the apparatus, and making it difficult to achieve a desired speed increase.

In the rotary loop type, on the other hand, numerous nozzles are installed at equal intervals on a chain that is mounted on a pair of sprockets, and these nozzles are caused to revolve at the same speed as the conveying speed of the bags. A part of the revolving path of these nozzles is set to run along the conveying path of the bags; and in this area of revolving path of the nozzles, the nozzles are advanced toward the bag mouths and inserted thereinto. Then, a gas is jet into the bags from the discharge openings of the nozzles so as to spread the bottoms of the bags, after which the nozzles are retracted and separated from the bag mouths.

In this rotary type, however, the structure that causes the nozzles to revolve and to advance and retract is complicated.

Furthermore, since the nozzles revolve in the horizontal plane, the connecting structure of the nozzles with a compressed gas source, etc. is also complicated, and the maintenance and cleaning characteristics are poor, thus being costly. In addition, since the structure is large in size, a large installation space is required for the packaging machine as whole. Moreover, the vibration and noise derived from the advancing and retracting action of the nozzles are present as in the above-described following-reciprocating motion type apparatus.

SUMMARY OF THE INVENTION

The present invention is to solve the problems with the prior art bag opening apparatuses used in continuous conveying type bag-filling packaging machines.

It is, therefore, an object of the present invention to provide an apparatus for opening bags that is simple in structure and compact in size, produces little vibration and noise and increases the speed of operation.

The above object is accomplished by a unique structure for an opening apparatus for bags in which a nozzle is inserted into a mouth of a bag among bags that are continuously conveyed at a constant speed and uniform intervals, and a gas is caused to jet into the bag from a discharge opening of the nozzle so as to open the bag, and in the present invention, the nozzle is continuously revolved on a circular track with the discharge opening thereof being kept to face the bottom of the bag so that the discharge opening advances toward and withdraws from the mouth of the bag which is on a conveying path of the bags, the circular track being substantially parallel to a conveying direction of the bags and within a plane that runs along longitudinal direction of the bags, and a time required for the nozzle to complete one revolution is set at an integral multiple of a time required for one bag to be conveyed over a distance between bags.

Needless to say, it is preferable that the speed of the nozzle in the conveying direction of the bags (i.e., the velocity component in the conveying direction) be set so that this speed is substantially the same as the conveying speed of the bags while the nozzle is inserted in the mouth of the corresponding bag. This can be realized in an ideal form by, for instance, setting the speed of the nozzle on the circular track at a speed that is constant and that is substantially the same as the conveying speed of the bags. The direction of revolution of the nozzle must be a direction that is the same as the conveying direction of the bags.

In the above structure, the nozzle is attached to a rotation transmitting member that performs a translational motion with the same radius of revolution and in the same direction of revolution as the nozzle.

The rotation transmitting member that performs this translational motion consistently faces in the same direction. Accordingly, the discharge opening of the nozzle also consistently faces in the same direction (toward the bottom of the corresponding bag) during the revolution of the nozzle. Of course, the revolution of the nozzle is also a translational motion. The mechanism that causes the rotation transmitting member to perform the translational motion includes two rotating shafts and supporting shafts. The rotating shafts rotate in synchronization in the same direction and respective supporting shafts that are attached to the rotating shafts. The supporting shafts are provided so as to be in eccentric positions which are offset by equal distances in the same direction with respect to the rotating shafts and revolve about the rotating shafts by the rotation of the rotating shafts. The rotation transmitting member is connected to these supporting shafts and makes a translational motion.

It is also preferable to install a plurality of nozzles on the rotation transmitting member so that the nozzles are arranged in the same direction as the conveying direction of the bags at intervals that are the same as the distance between bags that are next to each other. When only a single nozzle is installed along the conveying path of the bags, the time required for the nozzle to complete one revolution is set to be equal to the time that is required for one bag to be conveyed over the distance between bags. To the contrary, when a plurality of nozzles are employed, the time required for each nozzle to complete one revolution is set at a time that is obtained by multiplying the time required for one bag to be conveyed over the distance between bags next to each other by the number of nozzles. In this case, the radius of revolution of the nozzles is increased by the same factor.

The opening apparatus of the present invention is used mainly for bags that are conveyed horizontally in the direction of width of the bags with the bags being held in a vertical attitude and with the mouths of the bags facing upward, and further with both edges of the bags being held by grippers so that the bags are suspended or with the bags being held by retainers, etc. However, the opening apparatus of the present invention is also used in cases where the bags are conveyed horizontally in a direction other than the direction of width (e.g., in the direction perpendicular to the direction of width). In either case, the nozzle(s) revolve continuously on circular track(s) in a vertical plane that is parallel to the conveying direction of the bags (the he longitudinal direction of the bags is the vertical direction). In addition, the opening apparatus may take a structure in which bags are conveyed in the lateral direction, e.g., in which the bags are set in a horizontal attitude and conveyed in the direction of width and in the vertical direction.

Furthermore, the opening apparatus of the present invention is used mainly in cases where bags are conveyed in a rectilinear manner. However, by way of utilizing the flexibility of the bags, the opening apparatus can be used in cases where bags are conveyed along a curved conveying path as long as the curvature is relatively small. This structure refers to a case in which, for instance, the bags are held by numerous grippers disposed on the circumference of a rotating table that rotates in the horizontal direction, so that the bags are conveyed along a circular track with a relatively large radius in a vertical attitude with the mouths of the bags facing upward. In such cases, the circular track for the nozzle may be set by using, for instance, the mean conveying direction of the bags in a zone in which the nozzle is inserted into the bag as a reference. In concrete terms, this track for the nozzle is located within a vertical plane parallel to a tangent drawn to the conveying path of the bags at the position of maximum lowering of the nozzle. Alternatively, if a plurality of nozzles are installed in the above configuration, then the tracks may be set using the mean conveying direction for the same number of bags that correspond to the plurality of nozzles.

Furthermore, when bags are conveyed in the direction of width thereof with the bags being suspended in a vertical attitude, a pair of guide members can be employed. Typically, the guide members are respectively provided on either side of the conveying path of the bags so as to face the vicinity of the bottoms of the bags. The guide members approach and move away from the bags in relative terms. In other words, the guide members approach the bag surfaces in the vicinity of the bottoms of the bags from both sides prior to the initiation of the blowing-in of a gas from the nozzles, thus correcting warping of the bags; and then the guide members are moved away immediately after the blowing-in of the gas is initiated.

DETAILED DESCRIPTION OF THE INVENTION

The bag opening apparatus of the present invention will be described below with reference to the accompanying drawings.

The opening apparatus for bags of the present invention is used in a continuous conveying type bag-filling packaging machine. In this packaging machine, as shown in FIGS. 1 and 2, numerous self-standing bags 1 made of plastic are held at both edges thereof by grippers 2 and suspended in a vertical attitude with their bag mouths facing upward.

Figure 1:
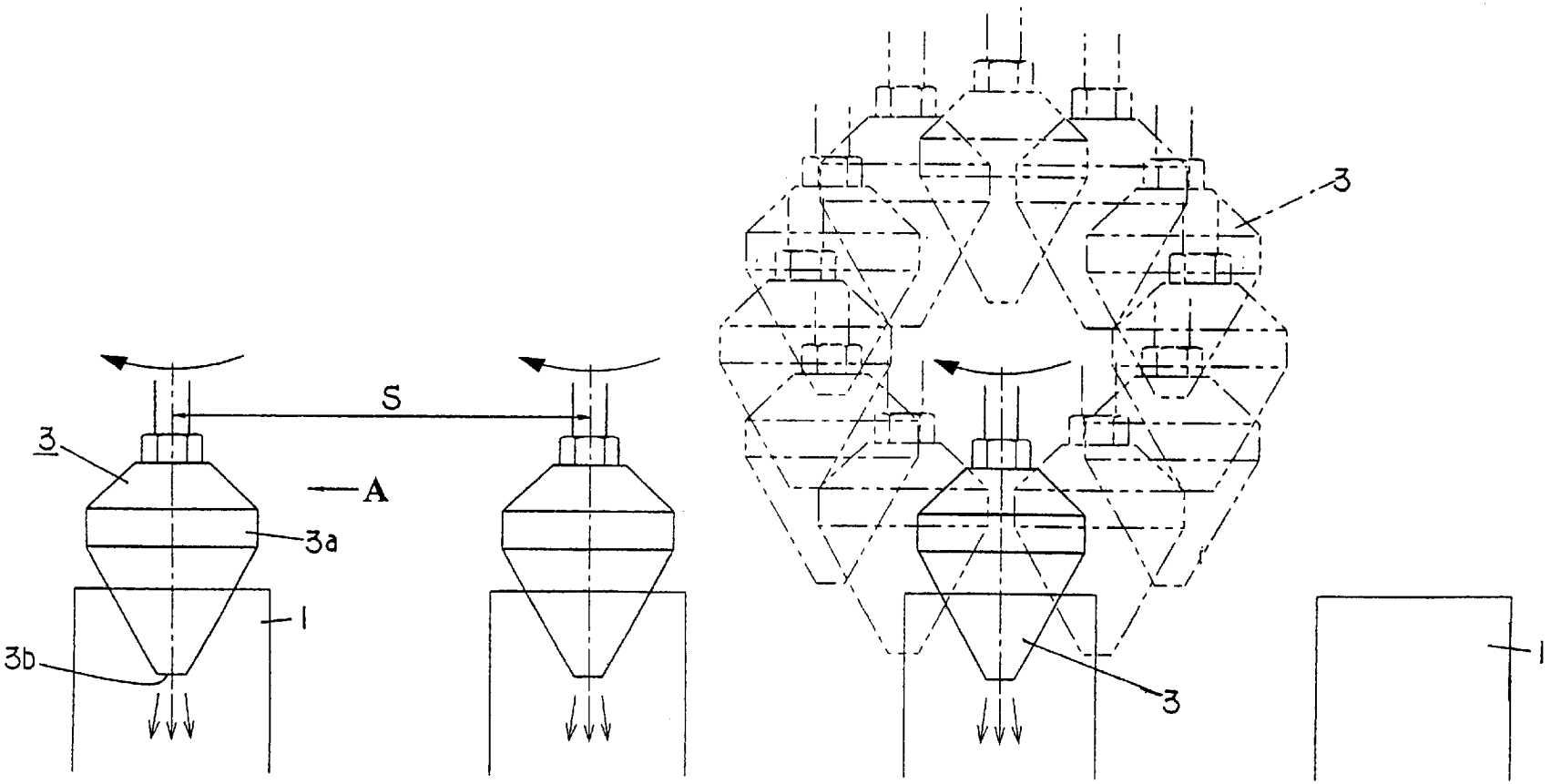
FIG. 1 is a schematic diagram illustrating the operation of the nozzles in the opening apparatus for bags according to the present invention.

The bags are continuously conveyed in the direction of width, as indicated by arrow A in FIG. 1, at a constant speed and uniform intervals over a conveying path for bags. The conveying path is set to be horizontal and rectilinear at least in the portion of the path involved in the opening process (i.e., the portion of the path shown in FIGS. 1 and 2). The opening process or mouth opening process is performed so as to spread open the bags (whose mouths have been opened for a certain extent by, for instance, suction disks in a preceding process) as far as the bottoms thereof.

Figure 2:
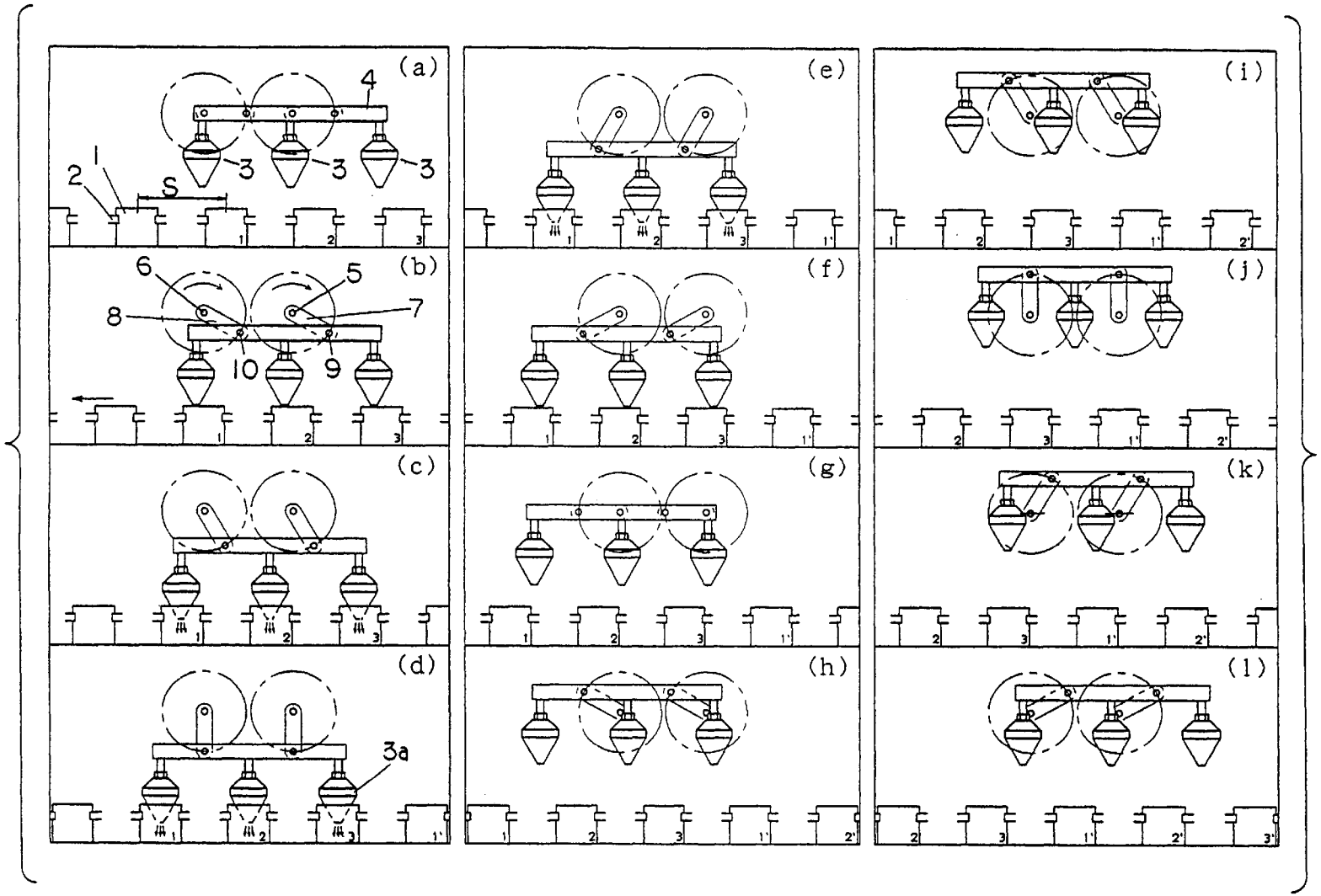
FIG. 2 is a schematic diagram illustrating the steps (a) through (l) taken in the bag mouth opening operation in the present invention.

Three nozzles 3 that form a part of the opening apparatus of the shown embodiment are, as shown in FIG. 2, provided at equal intervals on a horizontal rotation transmitting member 4 so that nozzle 3 are positioned directly above the conveying path of the bags. Each nozzle 3 is comprised of a conical shape head section 3*a* and a discharge opening 3*b*. The discharge opening 3*b* of the nozzles 3 is formed in the tip (lower) ends of the nozzles 3, and it faces downward.

Figure 3:
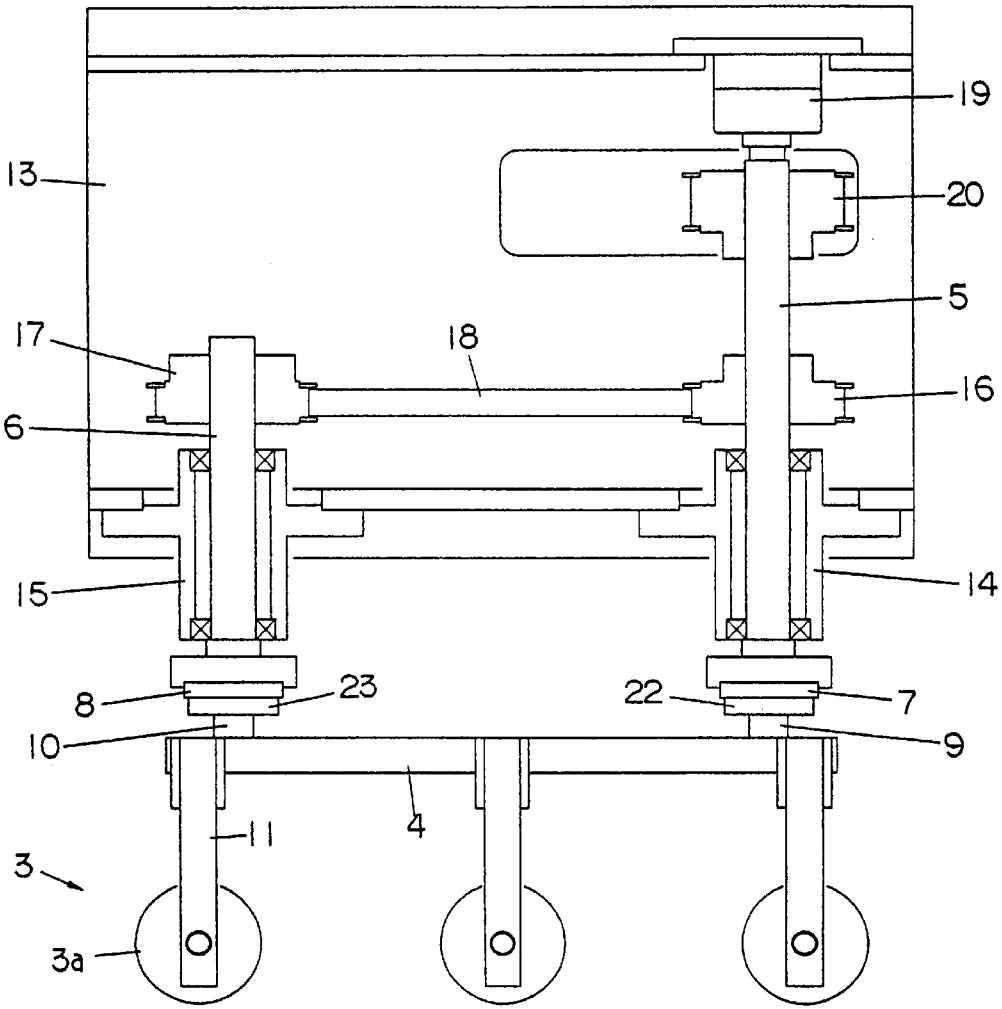
FIG. 3 is a partially sectional top view of the opening apparatus for bags according to the present invention.
Figure 4:
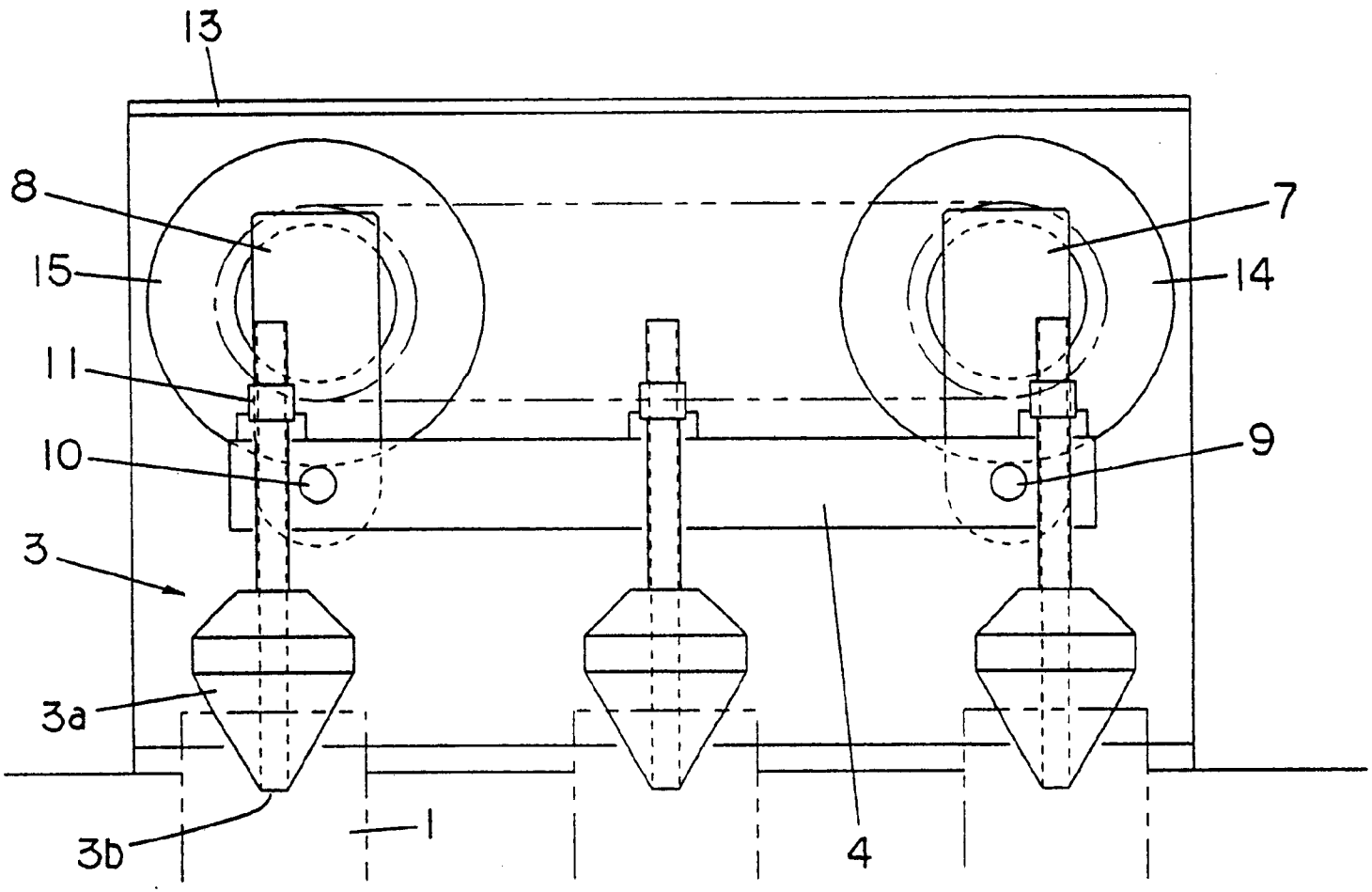
FIG. 4 is a front (vertical) view thereof.

The rotation transmitting member 4 is, as shown in FIGS. 3 and 4, attached via supporting shafts 9 and 10 to the tip ends of a pair of arms 7 and 8. The arms 7 and 8 are attached to and rotated together with two horizontal rotating shafts 5 and 6 that rotate at a constant speed in the same direction, so that the rotation transmitting member 4 is revolved in the same fashion as the arms 7 and 8. When the rotating shafts 5 and 6 are rotated, the arms 7 and 8 are rotated as shown by curved arrow in step (b) of FIG. 2, and thus the rotation transmitting member 4 revolves. This revolving movement of the rotation transmitting member 4 is made in the vertical plane while maintaining a horizontal attitude on exactly the principle of a parallel link mechanism. As a result, the respective nozzles 3 provided on the rotation transmitting member 4 are also revolved as shown by curved arrows in FIG. 1 at a constant speed on circular tracks in the vertical plane while maintaining the same attitude. The revolution of the rotation transmitting member 4 and nozzles 3 is a translational motion.

The spacing of the respective nozzles 3 is set to be equal to the distance S between bags (1 pitch which is a distance between centers of bags next to each other), and the respective nozzles 3 are set so that the nozzles 3 revolve at the same speed as the conveying speed of the bags. Furthermore, the time required for each of the nozzles 3 to complete one revolution is set to be equal to the time required for one bag 1 to be conveyed over a distance equal to three pitches of the distance S. In other words, the circumferential length of the circular track of each nozzle 3 is set at a length that is equal to three pitches (or three times the distance S). In addition, the timing of the revolution of the respective nozzles 3 and the timing of the conveying of the bags 1 is set so that the centers of the nozzles 3 coincide with the centers of the bags 1 in the direction of width when the nozzles 3 are lowered to the lower point (see the nozzles 3 shown by solid lines in FIG. 1) in the vertical circular tracks.

FIG. 2 shows the relationship between one cycle (one revolution) of each nozzle 3 and the conveying of the bags 1 in the steps (a) through (l) of the bag opening process. In FIG. 2, the numbers shown in the bags 1 are assigned in order to indicate the positions of the bags that are in a group opened at one time.

Steps (a) and (b): The nozzles 3 are being lowered, while revolving, toward the bags 1 on the conveying path. The bags 1 whose mouths have been opened for a certain extent in a preceding process are approaching the opening positions in a rectilinear manner.

Step (c): The head sections 3*a* (see FIG. 1) of the nozzles 3 are inserted into the mouths of the corresponding bags 1, and the jetting of a gas from the discharge openings 3*b* at the tip ends of the nozzles 3 is initiated.

Step (d): The nozzles 3 reach their lower points of the vertical circular tracks, and the head sections 3*a* of the nozzles 3 more or less seal the mouths of the bags, so that a pressure is applied to the insides of the bags, thus causing the bags 1 to be sufficiently spread open. The speed of the nozzles 3 in the conveying direction of the bags is kept equal to the conveying speed of the bags 1.

Step (e): The nozzles 3 begin to be moved upward and are in the process of being withdrawn from the mouths of the bags. When the nozzles 3 are positioned before the lower-end positions (i.e., in the positions shown in step (c)), and when the nozzles 3 are positioned beyond the lower-end positions (i.e., as the nozzles are moved into the positions shown in step (e)), the speed of the nozzles 3 in the conveying direction of the bags 1 is less than the conveying speed of the bags 1. However, this difference in speed between the bags conveyed linearly and the nozzles moving circularly is small. Also, the speed difference is absorbed by the flexibility of the bags 1 and the shape (conical shape) of the head sections 3*a* of the nozzles 3. Accordingly, the speed difference causes substantially no particular problems. In the meantime, the radius of revolution of the nozzles 3 can be set at a larger value by increasing the number of nozzles 3 installed on the rotation transmitting member 4. In such a case, the speed difference can be further reduced, and the time period for which the nozzles 3 are in the bags is lengthened. In this way, bag opening can be accomplished in a more stable and secure fashion.

Step (f): The nozzles 3 are raised even further and are separated from he mouths of the bags 1, whereupon the jetting of the gas is stopped.

Steps (g) through (l): The nozzles 3 are revolved further and raised and then begin to be moved downward, thus completing one cycle of the bag opening operation.

The opening apparatus will be described in more detail with reference to the embodiment shown in FIGS. 3 through 9.

Figure 5:
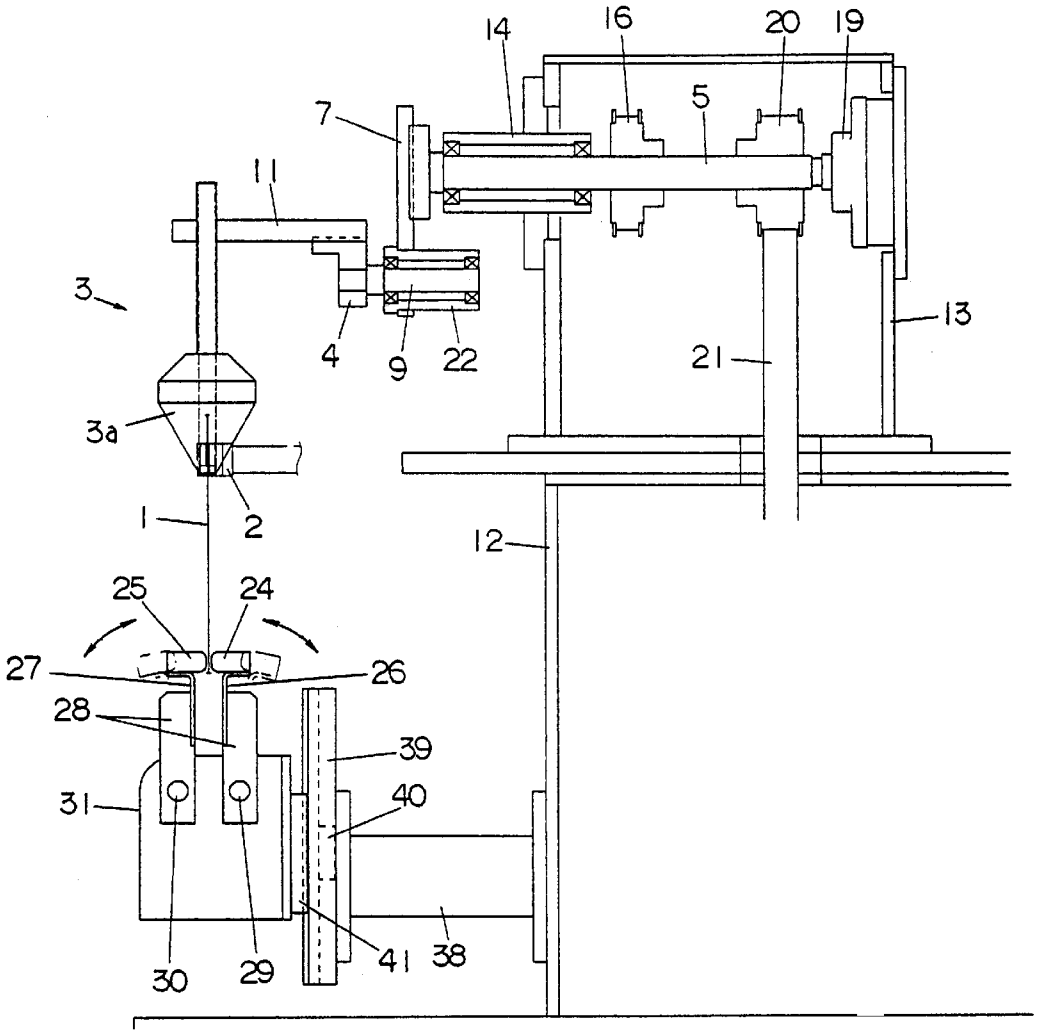
FIG. 5 is a partially sectional side view thereof.
Figure 6:
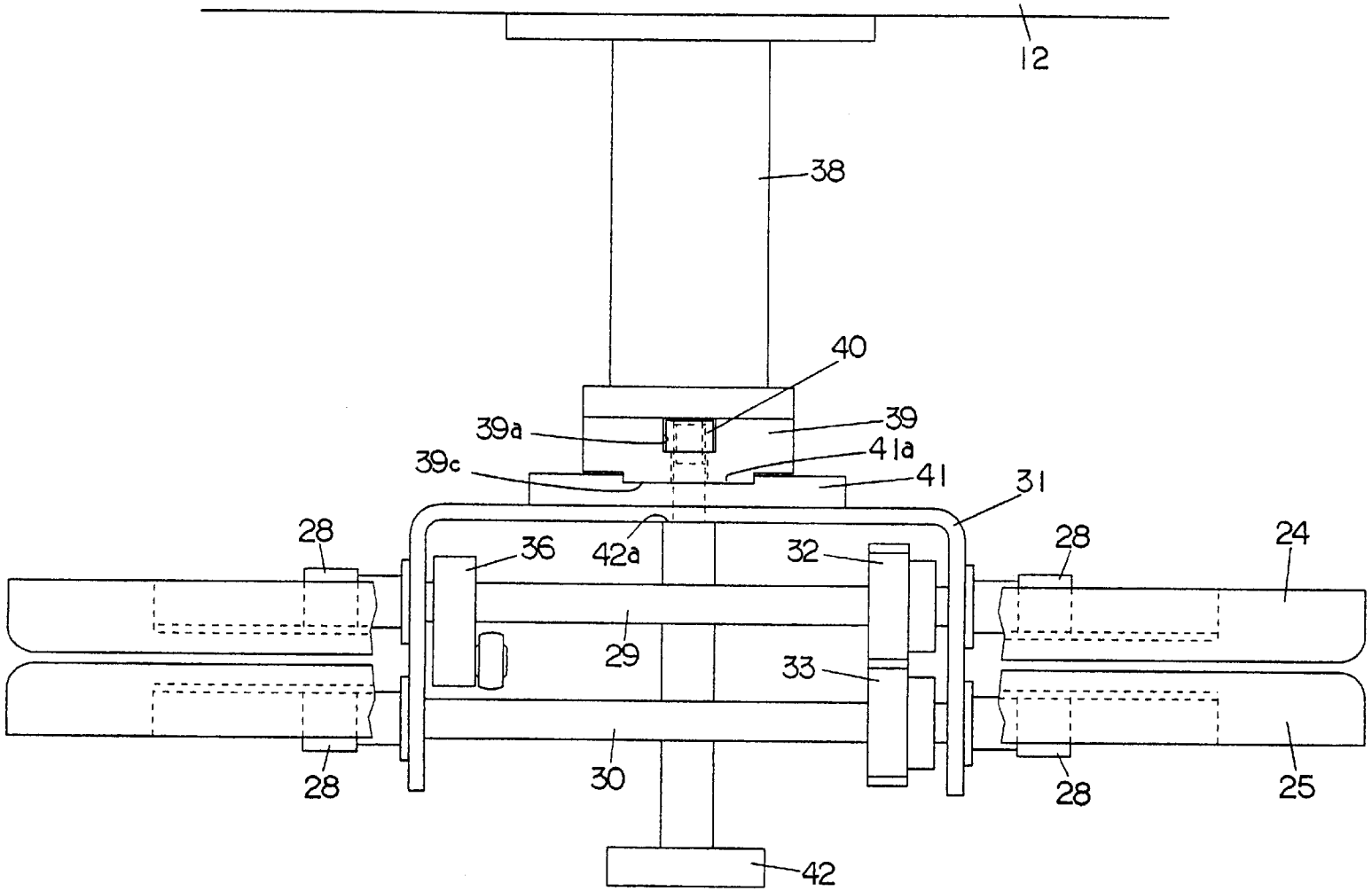
FIG. 6 is a top view of the guide device used in the opening apparatus of the present invention.

As shown in FIGS. 3 through 5, three nozzles 3 are attached to the rotation transmitting member 4 at the same height (see FIG. 4) via attachment plates 11. Head sections 3*a* which are inserted into the mouths of the bags 1 are provided at lower portions of the nozzles 3. Discharge openings 3*b* are opened in the tip (lower) ends of the nozzles 3, and the upper ends of the head sections 3*a* are connected to a compressed gas source via filters, switching valves, etc. (not shown).

Bearing holders 14 and 15 are, as seen from FIG. 5, attached to the front surface of a frame 13 that is disposed on a base 12 (see FIG. 4). Horizontal rotating shafts 5 and 6 are rotatably supported in the bearing holders 14 and 15 at the same height. The horizontal rotating shafts 5 and 6 are connected by toothed pulleys 16 and 17 and a timing belt 18 as shown in FIG. 3.

Furthermore, the rear end of the horizontal rotating shaft 5 is supported by a bearing 19 that is attached to the back surface of the frame 13. The horizontal rotating shaft 5 is connected to a driving source (not show) via a toothed pulley 20 and a timing belt 21. Accordingly, when the horizontal rotating shaft 5 is rotated at a constant speed by the driving source, the horizontal rotating shaft 6 is also rotated in synchronization in the same direction at the same speed.

Parallel arms 7 and 8 are respectively fastened to the tip ends of the horizontal rotating shafts 5 and 6. The supporting shafts 9 and 10 are provided, in a manner of free to rotate, on these arms 7 and 8 via bearing parts 22 and 23 in eccentric positions that are respectively offset from the horizontal rotating shafts 5 and 6 by equal distances in the same direction (see FIG. 4). The rotation transmitting member 4 is horizontally fastened to the tip ends of these supporting shafts 9 and 10.

With the above structure, when the horizontal rotating shafts 5 and 6 are, on the principle of a parallel link mechanism, rotated in synchronization, the rotation transmitting member 4 revolves at a constant speed while maintaining a horizontal attitude (see FIG. 2) that is parallel to the conveying direction of the bags 1 and located within the vertical plane. Accordingly, the respective nozzles 3 that are attached via the attachment plates 11 revolve with the same radius of revolution as the rotation transmitting member 4 with the discharge openings 3*b* consistently facing downward toward the bottoms of the bags. The revolution of the nozzles 3 is made within the vertical plane, and the orientation of the nozzles 3 does not vary. Accordingly, the connections of the nozzles to the compressed gas source, etc. can be done with a simple structure, and rotary valves, etc. for supplying the compressed gas are unnecessary.

FIGS. 5 through 8 show a guide device that is a part of the opening apparatus of the present invention.

The guide device includes a pair of guide members 24 and 25 which are disposed so as to face the vicinity of the bottoms of the bags and so that the guide members 24 and 25 are respectively on either side of the conveying path of the bags 1 as best seen from FIG. 5.

The guide members 24 and 25 are horizontally attached to respective attachment plates 26 and 27, and these attachment plates 26 and 27 are respectively fastened to horizontal opening-and-closing supporting shafts 29 and 30 via arms 28. The opening-and-closing supporting shafts 29 and 30 are supported on a supporting frame 31 so that these shafts pivot as shown by curved arrows in FIGS. 5 and 9. In other words, the shafts 29 and 30 are caused to pivot simultaneously in opposite directions by the engagement of gears 32 and 33 mounted thereon (see FIG. 6).

Figure 7:
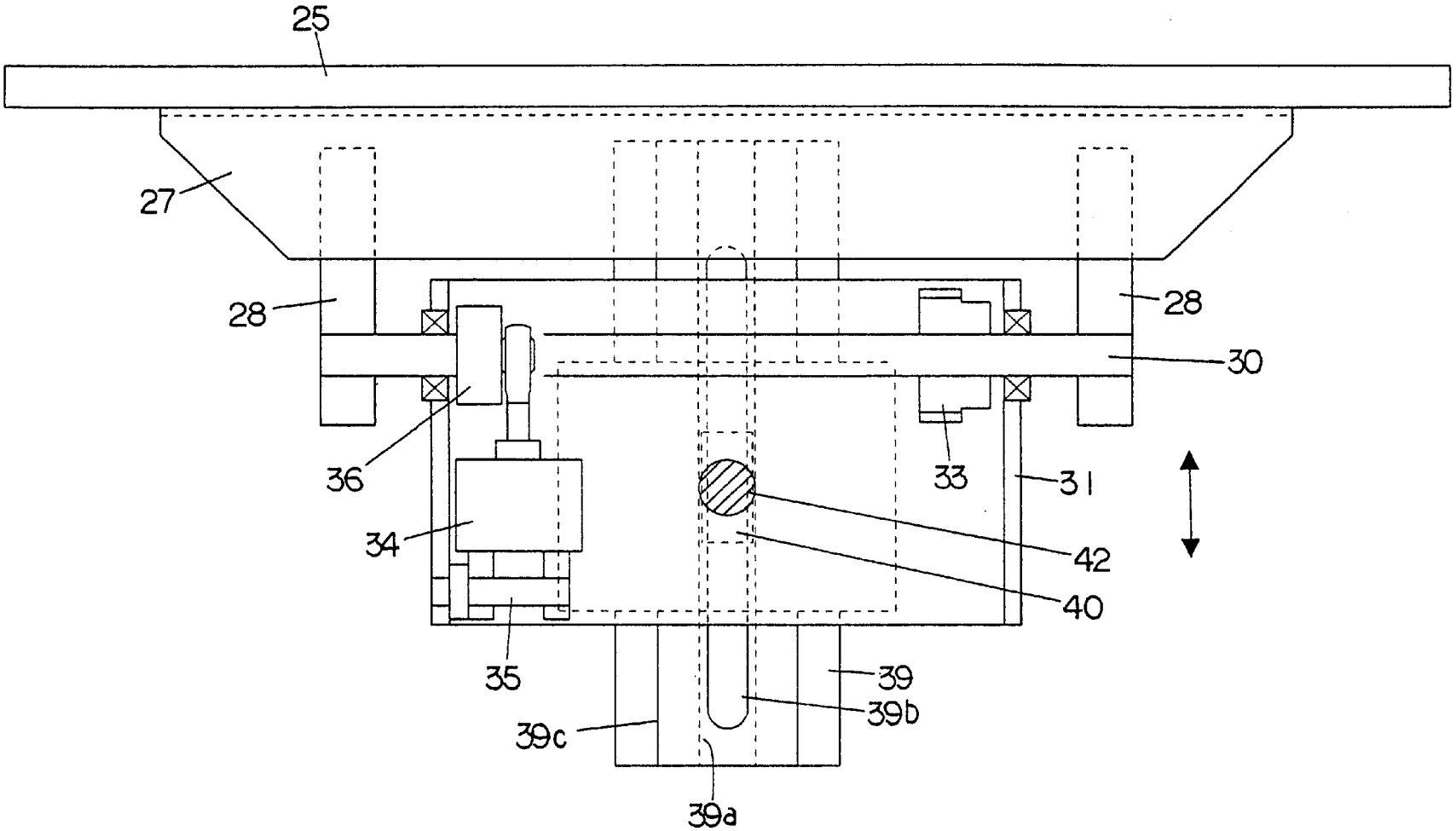
FIG. 7 is a partially sectional front (vertical) view thereof.

Furthermore, the rear end of an air cylinder 34 is pivotally connected to the supporting frame 31 by a pin 35 (see FIG. 7). The tip end of the cylinder rod 34*a* of the air cylinder 34 is rotatably connected via a connecting pin 37 to the end portion of an opening-and-closing lever 36 which is fastened to the opening-and-closing supporting shaft 29.

Figure 8:
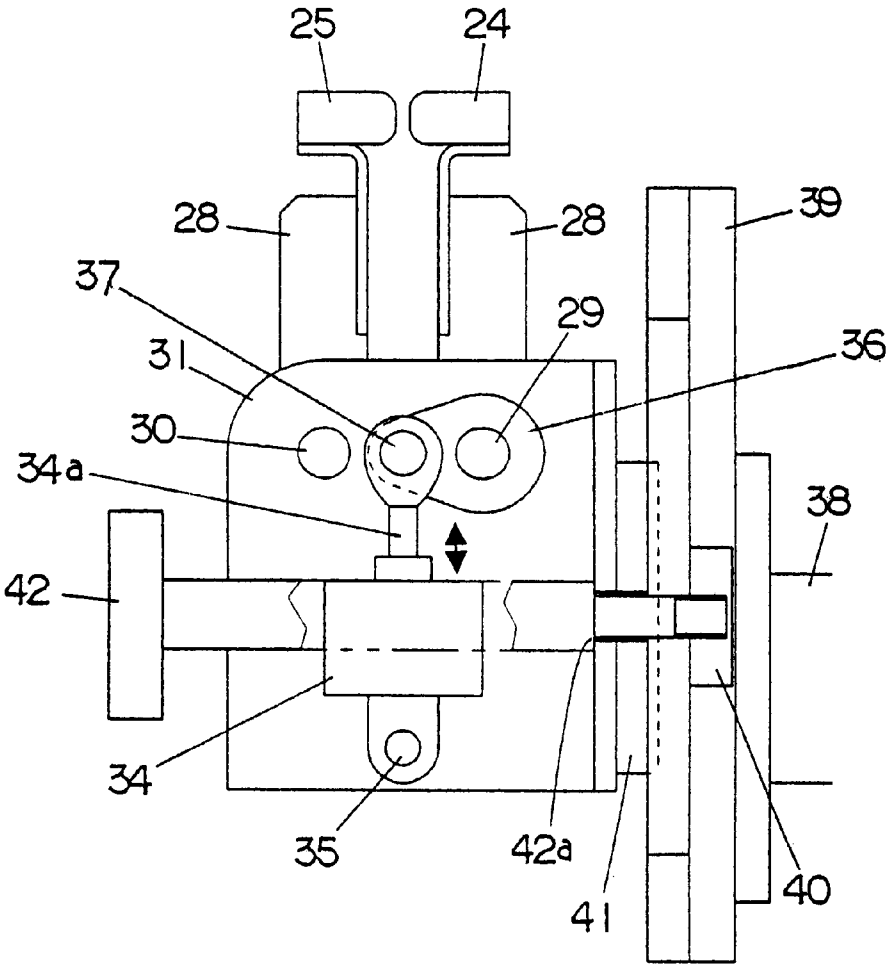
FIG. 8 is a partially sectional side view thereof.

When the air cylinder 34 is actuated, its cylinder rod 34*a* is moved up and down as shown by arrow in FIG. 8. Thus, the opening-and-closing supporting shaft 29 is rotated, and as a result the opening-and-closing supporting shaft 30 is rotated via the gears 32 and 33 engaged with each other. As a result, the guide members 24 and 25 pivot symmetrically with respect to each other as indicated by curved arrows in FIGS. 5 about the opening-and-closing supporting shafts 29 and 30 between the separated positions indicated by imaginary dashed lines and the closing positions indicated by solid lines.

Furthermore, a height adjustment plate 39 is provided on the side surface of the base 12 via an attachment frame 38. The height adjustment plate 39 has a vertical groove 39*a* on its back surface side (see FIG. 7), and a slot 39*b* and vertically oriented protruding strip 39*c* on its front surface side (see FIG. 6). A block-form nut member 40 is fitted into the vertical groove 39*a*, and the recessed groove 41*a* of a slide member 41 which is fastened to the back surface of the supporting frame 31 is fitted over the protruding strip 39*c* of the height adjustment plate 39.

A locking handle 42 is passed through the slot 39*b*, and the tip end of the locking handle 42 is screw-engaged with the nut member 40. When the locking handle 42 is turned in one direction and thus tightened, the supporting frame 31 is pressed against the height adjustment plate 39 by the shoulder 42*a* of the locking handle 42 and thus fastened in place. When the locking handle 42 is turned in another direction and thus loosened, then the supporting frame 31 becomes free to slide along the height adjustment plate 39. The height of the guide members 24 and 25 relative to the bottoms of the bags is adjusted as shown by arrow in FIG. 7.

The guide members 24 and 25 have at least a length shown by "2S+the width of the bags" that corresponds to the number of bags (three in this case) that are opened at one time along the conveying direction of the bags 1. Preferably, the length of the guide members 24 and 25 in the bag conveying direction is set so as to be at a slightly greater length including the amount by which the bags are conveyed.

Figure 9:
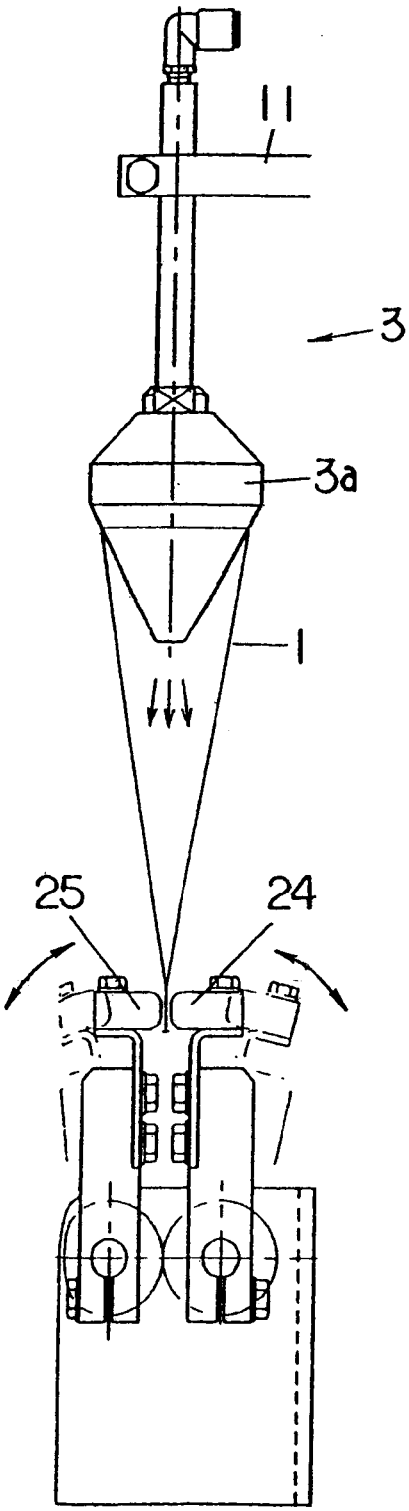
FIG. 9 is a diagram illustrating the function of the guide device.

The guide members 24 and 25 wait in the separated positions indicated by imaginary lines in FIGS. 5 and 9; then, immediately before the head sections 3*a* of the nozzles 3 are inserted into the bags 1 that are to be opened and the gas is caused to jet into the bags (i.e., immediately prior to the step (c) shown in FIG. 2), the guide members 24 and 25 pivot from both sides into the closing positions indicated by solid lines and correct the warping of the bags 1. Subsequently, after the blowing-in of the gas is initiated (at near the step (d) of FIG. 2), the guide members 24 and 25 are separated from each other and wait for the next operation to the next set of bags.

After the guide members 24 and 25 have corrected the warping of the bags 1, the bags 1 are spread open straight to the bottoms of the bags by blowing in the gas as shown in FIG. 9. If gas is blown into warped bags without applying any correcting movement to the bags by the guide members 24 and 25, the bags will warp further, and the bags cannot be spread open to the bottom.

As seen from the above, in the opening apparatus described above, the nozzles 3 revolve at a constant speed on circular tracks. Accordingly, almost no vibrations or noises are generated, and a high-speed operation is performed. Furthermore, with only the revolution of the nozzles 3 on circular tracks, a following motion of the nozzles 3 in the bag conveying direction and an advancing and retracting action of the nozzles 3 with respect to the mouths of the bags are simultaneously performed. Thus, the operating mechanism for the nozzles 3 is simple and compact, and the connecting structure with the compressed gas source, etc. can be also simplified. Accordingly, the overall structure can be extremely simple and compact, and the maintenance and cleaning characteristics are improved. Moreover, since the operating mechanism does not need to accelerate the nozzles from a stopped state and to decelerate the nozzles so as stop them, a corresponding saving in terms of distance and time is possible. Accordingly, the packaging machine as a whole can be compact, and only a small installation space is required.

As described above in detail, according to the present invention, the structure of an opening apparatus that opens continuously conveyed bags is simplified and becomes more compact. In addition, the opening apparatus of the present invention produces little vibration and noise and makes it possible to achieve the high-speed operation.

What is claimed is:

1. An opening apparatus for continuously conveyed bags in which a nozzle is inserted into a mouth of a bag among bags that are continuously conveyed at a constant speed and uniform intervals, and a gas is caused to jet into said bag from a discharge opening of said nozzle so as to open said bag, wherein said nozzle is continuously revolved on a circular track with said discharge opening of said nozzle being kept to face a bottom of said bag so that said discharge opening advances toward and withdraws from said mouth of said bag which is on a conveying path of said bags, said circular track being substantially parallel to a conveying direction of said bags and within a plane that runs along longitudinal direction of said bags, and a time required for said nozzle to complete one revolution is set at an integral multiple of a time required for one bag to be conveyed over a distance between bags next to each other.

2. The opening apparatus for continuously conveyed bags according to claim 1, wherein a speed of said nozzle on said circular track is set to be constant and at substantially same speed as a conveying speed at which said bags are conveyed.

3. The opening apparatus for continuously conveyed bags according to claim 1, wherein said nozzle is attached to a rotation transmitting member that performs a translational motion with a same radius of revolution and in a same direction of revolution as said nozzle.

4. The opening apparatus for continuously conveyed bags according to claim 2, wherein said nozzle is attached to a rotation transmitting member that performs a translational motion with a same radius of revolution and in a same direction of revolution as said nozzle.

5. The opening apparatus for continuously conveyed bags according to claim 3 or 4, wherein said rotation transmitting member is caused to perform said translational motion by a mechanism that comprises:

two rotating shafts that rotate in synchronization in a same direction, and supporting shafts that are respectively attached to said rotating shafts in eccentric positions that are offset by a same distance and in a same direction as each other, so that said supporting shafts revolve about said rotating shafts as said rotating shafts rotate, and wherein said rotation transmitting member is connected to said supporting shafts so as to perform said translational motion.

6. The opening apparatus for continuously conveyed bags according to claim 3 or 4, wherein said nozzle is provided in a plural number, and said plurality of nozzles are respectively disposed on said rotation transmitting member along said conveying path of said bags at intervals equal to a distance between bags next to each other, and a time required for each one of said plurality of nozzles to complete one revolution is set at a time that is obtained by multiplying a time required for one bag to be conveyed over a distance between bags next to each other by the number of said plurality of nozzles.

7. The opening apparatus for continuously conveyed bags according to claim 5, wherein said nozzle is provided in a plural number, and said plurality of nozzles are respectively disposed on said rotation transmitting member along said conveying path of said bags at intervals equal to a distance between bags next to each other, and a time required for each one of said plurality of nozzles to complete one revolution is set at a time that is obtained by multiplying a time required for one bag to be conveyed over a distance between bags next to each other by the number of said plurality of nozzles.

8. The opening apparatus for continuously conveyed bags according to any of one of claims 1 through 4, wherein said bags are conveyed horizontally with said bags taking a vertical attitude in which bag mouths face upward, and said nozzle revolves continuously on a circular track in a vertical plane parallel to said conveying direction of said bags.

9. The opening apparatus for continuously conveyed bags according to claim 5, wherein said bags are conveyed horizontally with said bags taking a vertical attitude in which bag mouths face upward, and said nozzle revolves continuously on a circular track in a vertical plane parallel to said conveying direction of said bags.

10. The opening apparatus for continuously conveyed bags according to claim 6, wherein said bags are conveyed horizontally with said bags taking a vertical attitude in which bag mouths face upward, and said nozzle revolves continuously on a circular track in a vertical plane parallel to said conveying direction of said bags.

11. The opening apparatus for continuously conveyed bags according to claim 7, wherein said bags are conveyed horizontally with said bags taking a vertical attitude in which bag mouths face upward, and said nozzle revolves continuously on a circular track in a vertical plane parallel to said conveying direction of said bags.

12. The opening apparatus for continuously conveyed bags according to any one of claims 1 through 4, wherein said bags are conveyed in a direction of width thereof with said bags being vertically suspended, and guide members are respectively provided on either side of said bag conveying path so as to face bottom areas of said bags, said guide members approaching and moving away from said bags in relative terms.

13. The opening apparatus for continuously conveyed bags according to claim 5, wherein said bags are conveyed in a direction of width thereof with said bags being vertically suspended, and guide members are respectively provided on either side of said bag conveying path so as to face bottom areas of said bags, said guide members approaching and moving away from said bags in relative terms.

14. The opening apparatus for continuously conveyed bags according to claim 6, wherein said bags are conveyed in a direction of width thereof with said bags being vertically suspended, and guide members are respectively provided on either side of said bag conveying path so as to face bottom areas of said bags, said guide members approaching and moving away from said bags in relative terms.

15. The opening apparatus for continuously conveyed bags according to claim 7, wherein said bags are conveyed in a direction of width thereof with said bags being vertically suspended, and guide members are respectively provided on either side of said bag conveying path so as to face bottom areas of said bags, said guide members approaching and moving away from said bags in relative terms.

16. The opening apparatus for continuously conveyed bags according to claim 8, wherein said bags are conveyed in a direction of width thereof with said bags being vertically suspended, and guide members are respectively provided on either side of said bag conveying path so as to face bottom areas of said bags, said guide members approaching and moving away from said bags in relative terms.

17. The opening apparatus for continuously conveyed bags according to claim 9, wherein said bags are conveyed in a direction of width thereof with said bags being vertically suspended, and guide members are respectively provided on either side of said bag conveying path so as to face bottom areas of said bags, said guide members approaching and moving away from said bags in relative terms.

18. The opening apparatus for continuously conveyed bags according to claim 10, wherein said bags are conveyed in a direction of width thereof with said bags being vertically suspended, and guide members are respectively provided on either side of said bag conveying path so as to face bottom areas of said bags, said guide members approaching and moving away from said bags in relative terms.

19. The opening apparatus for continuously conveyed bags according to claim 11, wherein said bags are conveyed in a direction of width thereof with said bags being vertically suspended, and guide members are respectively provided on either side of said bag conveying path so as to face bottom areas of said bags, said guide members approaching and moving away from said bags in relative terms.

* * * * *